US006277270B1

(12) United States Patent
Morel et al.

(10) Patent No.: US 6,277,270 B1
(45) **Date of Patent: *Aug. 21, 2001**

(54) PROCESS FOR CONVERTING HEAVY PETROLEUM FRACTIONS THAT COMPRISE A FIXED-BED HYDROTREATMENT STAGE, AN EBULLATED-BED CONVERSION STAGE, AND A CATALYTIC CRACKING STAGE

(75) Inventors: Frédéric Morel, Francheville; Jean-Luc Duplan, Irigny; Alain Billon, Le Vesinet; Stéphane Kressmann, Serezin du Rhone, all of (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/273,484

(22) Filed: Mar. 22, 1999

(30) Foreign Application Priority Data

Mar. 23, 1998 (FR) ..... 98 03654

(51) Int. Cl.[7] ..... C10G 47/00
(52) U.S. Cl. ..... 208/58; 208/59
(58) Field of Search ..... 208/58, 211, 212, 208/100, 213

(56) References Cited

U.S. PATENT DOCUMENTS 3,617,525 * 11/1971 Mortz ..... 208/211
3,830,731 * 8/1974 Reed et al. ..... 208/211
5,403,469 * 4/1995 Vauk et al. ..... 208/78

* cited by examiner

*Primary Examiner*—Helane E. Myers
(74) *Attorney, Agent, or Firm*—Millen, White, Zelano & Branigan, P.C.

(57) ABSTRACT

Process for converting a hydrocarbon fraction that is obtained from atmospheric distillation of a crude, comprising a vacuum distillation stage (a) of said feedstock that makes it possible to obtain a vacuum distillate and a vacuum residue; a stage b) for treating at least a portion of the vacuum distillate in the presence of hydrogen in at least one reactor that contains at least one fixed-bed hydrotreatment catalyst under conditions that make it possible to obtain a liquid effluent with a low sulfur content; a stage c) for treating at least a portion of the vacuum residue in the presence of hydrogen in at least one triphase reactor that contains at least one ebullated-bed hydrotreatment catalyst; a stage d) in which at least a portion of the product that is obtained in stage b) is sent to an atmospheric distillation zone from which a light fraction and a heavier liquid fraction are recovered; a stage e) in which at least a portion of the product that is obtained in stage c) is sent to an atmospheric distillation zone from which a light fraction and a heavier liquid fraction are recovered; and optionally a catalytic cracking stage f) in which at least a portion of the heavier liquid fractions that are obtained in stages d) and e) are at least partially cracked into lighter fuel-type fractions.

20 Claims, 1 Drawing Sheet

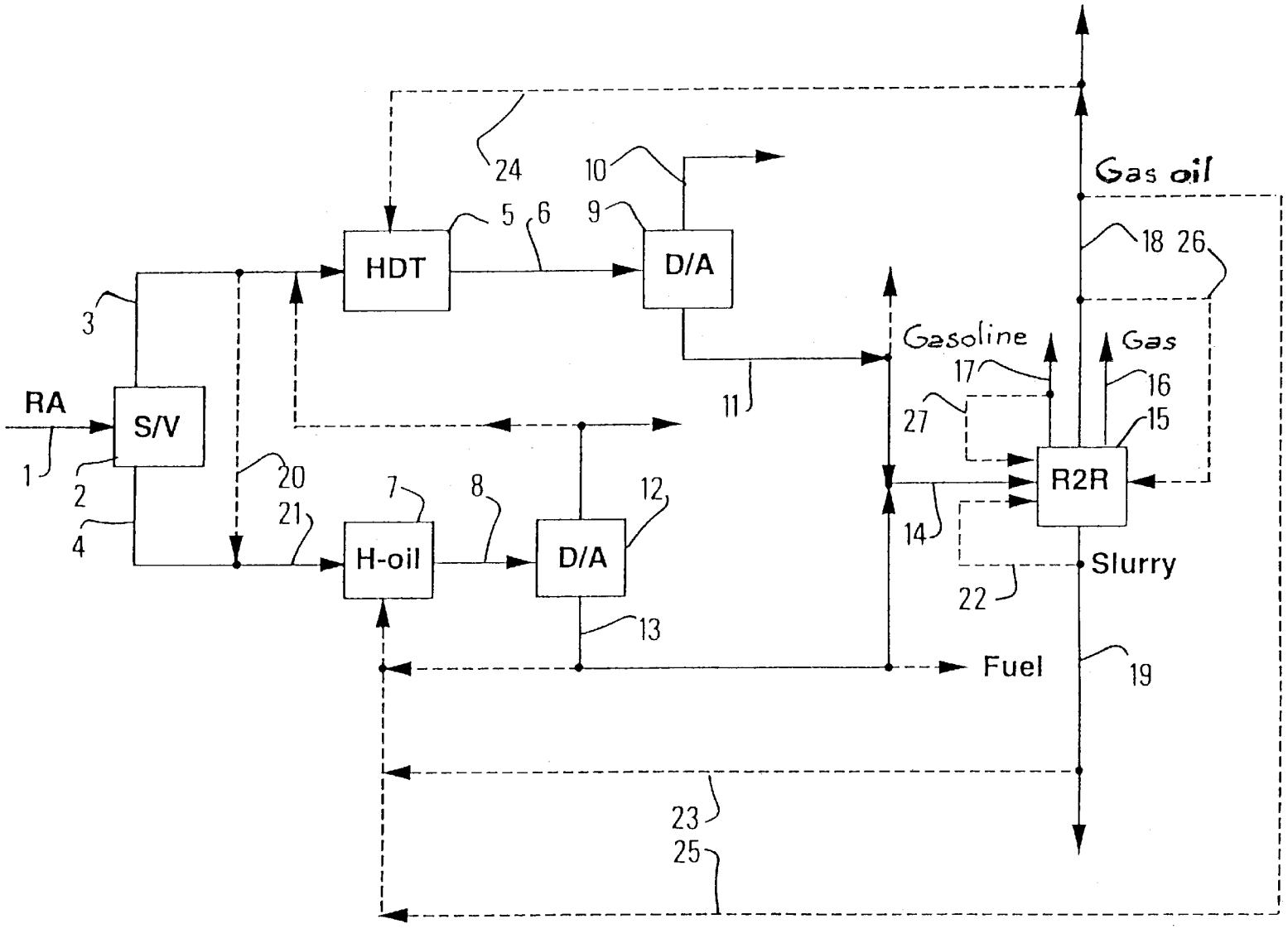
RA
S/V
HDT
H-oil
D/A
D/A
R2R
Gas oil
Gas
Gasoline
Slurry
Fuel
1
2
3
4
5
6
7
8
9
10
11
12
13
14
15
16
17
18
19
20
21
22
23
24
25
26
27

PROCESS FOR CONVERTING HEAVY PETROLEUM FRACTIONS THAT COMPRISE A FIXED-BED HYDROTREATMENT STAGE, AN EBULLATED-BED CONVERSION STAGE, AND A CATALYTIC CRACKING STAGE

CROSS REFERENCE TO RELATED APPLICATION

This application is related to applicants concurrently filed application Attorney Docket No. Pet-1745, entitled "Process For Converting Heavy Petroleum Fractions That Comprise A Distillation Stage", Ebullated-Bed Hydroconversion Stages Of The Vacuum Distillate, And A Vacuum Residue And A Catalytic Cracking Stage, based on French Application 98/03.655 filed Mar. 23, 1998.

This invention relates to the refining and conversion of heavy hydrocarbon fractions that contain, among other things, sulfur-containing impurities. It relates more particularly to a process that makes it possible to convert, at least partly, at relatively low pressure a hydrocarbon feedstock, for example an atmospheric residue that is obtained by direct distillation of a crude into light gasoline and gas oil fractions of good quality and into a heavier product that is used as a feedstock for catalytic cracking in a fluidized-bed catalytic cracking unit that comprises a double regeneration system and optionally a system for cooling the catalyst at the level of regeneration. In one of these aspects, this invention also relates to a process for the production of gasoline and/or gas oil that comprises at least one fluidized-bed catalytic cracking stage.

One of the objectives of this invention consists in producing from a certain special fraction hydrocarbons, which will be specified in the description below, by partial conversion of said fractions of lighter fractions that are easily upgraded, such as engine fuels, gasoline, and gas oil.

Within the framework of this invention, the conversion of the lighter fraction feedstock is usually between 20 and 75% and most often between 25 and 60% and even limited to about 50%.

The feedstocks that are treated within the framework of this invention are atmospheric residues of direct distillation. These feedstocks are usually hydrocarbon fractions that have a sulfur content of at least 0.5%, often at least 1%, and very often at least 2% by weight, and an initial boiling point of at least 300° C., often at least 360° C., and most often at least 370° C., and a final boiling point of at least 500° C., often at least 550° C., and can go beyond 600° C. and even 700° C.

The object of this invention is to obtain a product with a low sulfur content under conditions in particular of relatively low pressure in order to limit the necessary investment cost. This process makes it possible to obtain a gasoline-type engine fuel, a typical engine fuel, and a residue whose initial boiling point is, for example, about 370° C., which is sent as a feedstock or as a portion of feedstock into a catalytic cracking residue stage such as a double regeneration reactor.

In its broader form, this invention is defined as a process for converting a hydrocarbon fraction that contains basically the atmospheric residue of the direct distillation of a crude, characterized in that it comprises the following stages: (the numbers in parentheses refer to the FIGURE):

a) Feedstock (1) that contains hydrocarbon is sent to a vacuum distillation zone (2) from which a vacuum distillate [DSV(3)] and a vacuum residue [RSV(4)] are recovered and which most often has an initial boiling point of at least about 300° C. and often at least about 350° C. and even at least about 370° C.

b) At least a portion of the vacuum distillate that is obtained in stage a) is treated in the presence of hydrogen in at least one hydrotreatment section (5) that comprises at least one reactor that contains at least one fixed bed of hydrotreatment catalyst that preferably has a strong hydrodesulfurizing activity, under conditions that make it possible to obtain a liquid feedstock (6) with low contents of Conradson carbon, metals, sulfur, and most often nitrogen as well.

c) At least a portion of the vacuum residue that is obtained in stage a) is treated in at least one hydroconversion section (7) in the presence of hydrogen, whereby said section comprises at least one triphase reactor, contains at least one ebullated-bed hydroconversion catalyst, and operates generally with a rising flow of liquid and gas, whereby said reactor comprises at least one means of drawing off the catalyst to the outside of said reactor that is located close to the bottom of the reactor and at least one means of make-up for fresh catalyst in said reactor that is located close to the top of said reactor, under conditions that make it possible to obtain a liquid feedstock (8) with low contents of Conradson carbon, metals, and sulfur.

d) At least a portion of the hydrotreated liquid effluent that is obtained from stage b) is sent to an atmospheric distillation zone from which are recovered an atmospheric distillate (10) and an atmospheric residue that most often has an initial boiling point of at least about 300° C. and often at least about 350° C., or at least about 370° C.

e) At least a portion of the hydroconverted liquid effluent that is obtained from stage c) is sent to an atmospheric distillation zone from which are recovered an atmospheric distillate (12) and an atmospheric residue (13) that most often has an initial boiling point of at least about 300° C. and often at least about 350° C. and even of at least about 370° C., and optionally f) At least a portion of the atmospheric residue that is obtained in stage d) is mixed with at least a portion of the atmospheric residue that is obtained in stage e), and this mixture (14) is sent into a catalytic cracking residue section (15) in which it is treated under conditions that make it possible to obtain a gas fraction (16), a fuel fraction (17) that comprises a gasoline fraction and a gas oil fraction (18), and a slurry fraction (19). The quantity of atmospheric residue that is obtained in stage d) and that is sent in a mixture with the atmospheric residue of stage e) into catalytic cracking stage f) should be sufficient to ensure that this mixture preferably has a Conradson carbon that is less than or equal to 10 and often less than or equal to 8.

The treatment section of stage c) comprises at least one reactor, but it is often advantageous to use a treatment section that comprises several reactors. In a preferred embodiment, this section will comprise at least two reactors that are arranged in series and often between 2 and 6 reactors that are arranged in series. This section most often comprises two to four reactors that are arranged in series.

The framework of this invention would not be exceeded by including one or more reactors that each comprise, for example, at least one fixed catalyst bed, before the ebullated-bed treatment section of stage c) and before the hydrotreatment section of stage b). Some of these reactors can be arranged in series, while others that form what one skilled in the art calls guard reactors can be arranged in parallel and operate, for example, alternately. Alternate operation is defined here as an operation in which while one or more reactors are operating, the other reactor or series of reactors is isolated, and the catalyst beds that they contain are being regenerated. The use of such an arrangement that comprises at least one reactor that contains at least one fixed catalyst bed before the treatment section of a ebullated bed is not necessarily a preferred embodiment of this invention, however.

The treatment section of stage b) comprises at least one reactor, but it is often advantageous to use a treatment section that comprises several reactors, of which some are arranged in series, whereas others that form what one skilled in the art calls guard reactors can be arranged in parallel and operate, for example, alternately. Alternate operation is defined here as an operation in which while one or more reactors are operating, the other reactor or series of reactors is isolated, and the catalyst beds that they contain are being regenerated.

Hydroconversion section (c) comprises at least one reactor.

In a preferred embodiment, this section will comprise at least two reactors that are arranged in series and often between 2 and 6 reactors that are arranged in series. This section most often comprises two to four reactors that are arranged in series.

According to a variant, which is advantageous when the vacuum residue that is obtained in stage a) is particularly viscous, a portion of the vacuum distillate that is obtained in stage a) (line 20) is sent in a mixture with the vacuum residue of this stage to hydroconversion stage c) (line 21).

According to another variant, an atmospheric residue portion that is obtained in stage d) can be sent to a standard catalytic cracking fluidized-bed stage or to a hydrocracking stage.

The atmospheric distillates that are obtained in stages d) and e) are most often sent individually or in a mixture into a distillation zone that makes it possible to obtain a gasoline fraction and a gas oil fraction, which are sent respectively into the gasoline pool and into the gas oil pool. According to a variant, however, it may be advantageous to use at least a portion of the atmospheric distillate that is obtained in stage d) at the input of stage b) in a mixture with the vacuum distillate of stage a). According to this variant, the amount of product that is treated in stage b) is larger, and thus a larger amount of product and in particular of gasoline that has a low sulfur content is obtained.

According to another variant, a portion of the atmospheric residue that is obtained in stage e) can be sent to the heavy fuel pool of the refinery. According to another variant, a portion of the atmospheric residue that is obtained in stage e) can be sent into hydroconversion stage c).

According to another variant, the fuel fraction (gasoline) that is obtained in catalytic cracking residue stage f) is usually at least partly sent to the fuel pools, and the slurry fraction will be, for example, at least partly or even completely sent to the heavy fuel pool or recycled at least partly and even completely to catalytic cracking stage f) (line 22). It is also possible to recycle at least a portion of this slurry fraction in hydroconversion stage c) (line 23). In a particular embodiment of the invention, a portion of the gas oil fraction that is obtained during this stage f) is recycled either to stage b) (line 24) or to stage c) (line 25) or to stage f) in a mixture with the feedstock that is introduced into this catalytic cracking stage f). Likewise, in another special implementation, it is possible to recycle a portion of the gasoline fraction that is produced during stage f) in this stage f) in a mixture with the feedstock that is introduced into this catalytic cracking stage f). In this description, the term "a portion of the gas oil fraction or of the gasoline fraction" is defined as a fraction that is less than 100%. It is also possible within the scope of this invention to recycle all of the gas oil that is obtained by catalytic cracking either to stage b) or to stage c) or to stage f), or a fraction may be recycled to each of these stages, whereby the sum of these fractions represents 100% of the gas oil fraction that is obtained in stage f).

In the vacuum distillation zone of stage a), the conditions are generally selected in such a way that the cutpoint is from about 300 to about 400° C. and often from about 350 to about 390° C., and most often from about 370 to about 380° C.

The conditions of stage b) for treating the vacuum distillate that is obtained from stage a) in the presence of hydrogen are usually as follows. In the hydrotreatment zone, at least one fixed bed of a standard hydrotreatment catalyst and preferably at least one of the catalysts that are described by the applicant, in particular at least one of those that are described in Patents EP-B-113297 and EP-B-113284, are used. The procedure is usually carried out under an absolute pressure of from 2 to 35 MPa, often from 5 to 20 MPa, and most often from 6 to 10 MPa at a temperature of about 300 to about 500° C. and often from about 350° C. to about 450° C. The VVH and partial pressure of hydrogen are important factors that are selected based on the characteristics of the feedstock that is to be treated and the desired conversion. Most often, the VVH is located in a range from about 0.1 to about 5 and preferably from about 0.5 to about 2. The amount of hydrogen that is mixed with the feedstock is usually from about 100 to about 5000 N meters cubed ($Nm^3$) per meter cubed ($m^3$) of liquid feedstock and most often from about 200 to about 1000 $Nm^3/m^3$ and preferably from about 300 to about 500 $Nm^3/m^3$. The procedure is usefully carried out in the presence of hydrogen sulfide, and the partial pressure of hydrogen sulfide is usually from about 0.002 times to about 0.1 times and preferably from about 0.005 times to about 0.05 times the total pressure. In the hydrotreatment zone, the ideal catalyst is to have a strong hydrogenating power to produce a deep refining of the products and to obtain a significant reduction of sulfur. For example, one of the catalysts that are described by the applicant in Patents EP-B-113297 and EP-B-113284 can be used. In the preferred embodiment in the hydrotreatment zone, significant hydrodesulfurization is carried out, and the procedure is carried out at a relatively low temperature; this tends to produce deep hydrogenation and limited coking. It is possible to use a standard catalyst such as, for example, a catalyst that contains cobalt and molybdenum on an alumina-based substrate: see, for example, ULLMANS ENCYCLOPEDIA OF INDUSTRIAL CHEMISTRY VOLUME A 18, 1991, PAGE 67 TABLE 4. For example, one of the catalysts that are sold by the PROCATALYSE Company under reference HR306C or HR316C and that contain cobalt and molybdenum or the one that is sold under reference HR348 and that contains nickel and molybdenum will be used. The scope of this invention would not be exceeded by including in this stage one or more catalytic guard beds at the top of the reactor or in one or more so-called guard reactors, to trap the last traces of metals that are still present in the product before the product is introduced into this stage e). It is possible to use one or more catalysts either in the same reactor or in several reactors that are usually arranged in series. This stage b) is usually carried out industrially in one or more liquid down-flow reactors. In this zone, in addition to the hydrodesulfurization of the feedstock, hydrodemetalization of this feedstock is usually also carried out. The hydrodesulfurization and hydrodemetalization can be carried out simultaneously with the aid of a catalyst that ensures these two functions or with at least two catalysts, whereby one is more particularly active in terms of hydrodesulfurization and the other is more particularly active in terms of hydrodesulfurization. These catalysts can be used in a mixture or in successive beds. It is also possible to carry out these two treatments in two separate subzones. In the case where the hydrodesulfurization zone is separate from the hydrodemetalization zone, it is possible to operate at a relatively low temperature, i.e., considerably below the temperature of the hydrodemetalization zone; this tends to produce deep hydrogenation and limited coking. The scope of this invention therefore will not be exceeded by using the same catalyst in the two zones, either by regrouping these two zones so that it forms only a single zone in which the hydrodemetalization and hydrodesulfurization would be carried out simultaneously or successively with a single catalyst or with several different catalysts.

Stage c) for hydroconverting the vacuum residue that is obtained in stage a) is usually carried out under standard ebullated-bed hydroconversion conditions of a liquid hydrocarbon-containing fraction. The procedure is usually carried out under an absolute pressure of 2 to 35 MPa, often from 5 to 25 MPa, and most often from 6 to 20 MPa at a temperature of about 300 to about 550° C. and often from about 350 to about 500° C. The hourly volumetric flow rate (VVH) and the partial hydrogen pressure are important factors that are selected based on the characteristics of the product that is to be treated and the desired conversion. Most often, the VVH is located in a range from about $0.1^{-1}$ to about 10 $h^{-1}$ and preferably about 0.15 $h^{-1}$ to about 5 $h^{-1}$. The amount of hydrogen that is mixed with the feedstock is usually from about 50 to about 5000 N meters cubed ($Nm^3$) per meter cubed ($m^3$) of liquid feedstock and most often from about 100 to about 1000 $Nm^3/m^3$ and preferably from about 300 to about 500 $Nm^3/m^3$. It is possible to use a standard granular catalyst for hydroconversion. This catalyst can be a catalyst that comprises metals from group VIII, for example nickel and/or cobalt, most often combined with at least one metal of group VIB, for example, molybdenum. It is possible, for example, to use a catalyst that comprises 0.5 to 10% by weight of nickel and preferably 1 to 5% by weight of nickel (expressed in nickel oxide NiO) and from 1 to 30% by weight of molybdenum, preferably from 5 to 20% by weight of molybdenum (expressed in molybdenum oxide $MoO_3$) on a substrate, for example an alumina substrate. This catalyst is most often in extrudate or ball form. The catalyst that is used is partly replaced with fresh catalyst by drawing off at the bottom of the reactor and introducing at the top of the reactor fresh or new catalyst at regular intervals, i.e., for example, in bursts or in an almost continuous way. It is possible, for example, to introduce fresh catalyst every day. The replacement rate of the used catalyst by fresh catalyst can be, for example, from about 0.05 kilogram to about 10 kilograms per meter cubed of feedstock. Said draw-off and replacement are carried out with devices that make it possible for this hydroconversion stage to operate continuously. The unit usually comprises a recirculation pump that makes it possible to keep the catalyst in an ebullated bed by continuously recycling at least a portion of the liquid that is drawn off at the top of the reactor and reinjected at the bottom of the reactor. It is also possible to send the used catalyst that is drawn off from the reactor to a regeneration zone in which the carbon and sulfur that it contains are eliminated and then to send this regenerated catalyst back into hydroconversion stage c).

This stage c) is implemented under the conditions of, for example, the H-Oil process as described in, for example, Patents U.S. Pat. No. 4,521,295 or U.S. Pat. No. 4,495,060 or U.S. Pat. No. 4,457,831 or U.S. Pat. No. 4,354,852 or in the Aiche article, March 19–23, HOUSTON, Tex., paper number 46a. Second Generation Ebullated Bed Technology.

In this stage c), it is possible to use at least one catalyst that ensures both demetalization and desulfurization, under conditions that make it possible to obtain a liquid feedstock with low contents of metals, Conradson carbon, and sulfur and that make it possible to obtain extensive conversion of light products, i.e., in particular gasoline and gas oil fuel fractions.

In the atmospheric distillation zones of stages d) and e), the conditions are generally selected in such a way that the cutpoint is from about 300 to about 400° C. and often from about 350 to about 390° C., and most often from about 370 to about 380° C. This cutpoint may be different in each of these stages, but it is most often preferably identical in each of them.

Catalytic cracking stage f) is a catalytic cracking residue stage in a fluidized bed, for example, according to the process that is developed by the applicant that is referred to as R2R. This stage can be executed in a standard manner that is known to ones skilled in the art under suitable cracking conditions with a view to producing hydrocarbon-containing products of lower molecular weight. Descriptions of operation and of catalysts that can be used within the framework of cracking in a fluidized bed in this stage f) are given in, for example, the documents of Patents U.S. Pat. No. 4,695,370, EP-B-184517, U.S. Pat. No. 4,959,334, EP-B-323297, U.S. Pat. No. 4,965,232, U.S. Pat. No. 5,120,691, U.S. Pat. No. 5,344,554, U.S. Pat. No. 5,449,496, EP-A-485259, U.S. Pat. No. 5,286,690, U.S. Pat. No. 5,324,696 and EP-A-699224, whose descriptions are considered as being incorporated herein solely from the fact of this citation.

The fluidized-bed catalytic cracking reactor can operate with an upward or downward flow. Although this is not a preferred embodiment of this invention, it is also conceivable to carry out catalytic cracking in a fluidized-bed reactor. In the case where the feedstock that is introduced into the catalytic cracking reactor has a relatively high content of Conradson carbon (for example a content of greater than or equal to 7), it will advantageously be possible to use equipment that comprises at least one heat-exchange device on the solid particles of the catalyst at the level of the regenerators. As an example, it will be possible to use one of the devices that are described by the applicant in Patents U.S. Pat. No. 5,120,691, U.S. Pat. No. 5,286,690, U.S. Pat. No. 5,324,696 or FR-A-2695045 whose descriptions are considered incorporated herein solely by the fact of this citation. The particularly preferred catalytic cracking catalysts are those that contain at least one zeolite that is usually mixed with a suitable matrix, such as, for example, alumina, silica, or silica-alumina.

According to the variant in which an atmospheric residue portion that is obtained in stage d) is sent into a standard catalytic cracking stage most often in a fluidized bed, or into a standard hydrocracking stage, the operating conditions of these stages are standard conditions that are well known to one skilled in the art. For example, a brief description of catalytic cracking (whose first industrial use dates back to 1936 (HOUDRY process) or in 1942 for the use of a fluidized-bed catalyst) will be found in ULLMANS ENCYCLOPEDIA OF INDUSTRIAL CHEMISTRY VOLUME A 18, 1991, pages 61 to 64. Usually, a standard catalyst that comprises a matrix, optionally an additive, and at least one zeolite, is used. The amount of zeolite is variable, but usually from about 3 to 60% by weight, often from about 6 to 50% by weight, and most often from about 10 to 45% by weight. The zeolite is usually dispersed in the matrix. The amount of additive is usually from about 0 to 30% by weight and often from about 0 to 20% by weight. The amount of matrix represents the addition to 100% by weight. The additive is generally selected from the group that is formed by the oxides of the metals of group IIA of the periodic table, such as, for example, magnesium oxide or calcium oxide, the rare-earth oxides, and the titanates of the metals of group IIA. The matrix is most often a silica, an alumina, a silica-alumina, a silica-magnesia, a clay, or a mixture of two or more of these products. The most commonly used zeolite is zeolite Y. Cracking is carried out in a reactor that is approximately vertical or that is in upward mode (riser) or in downward mode (dropper). The selection of the catalyst and the operating conditions are functions of the products that are sought based on the treated feedstock, as is described in, for example, the article by M. MARCILLY, pages 990–991 that is published in the French Petroleum Institute Journal, November–December 1975, pages 969–1006. The procedure is usually carried out at a temperature of about 450 to about 600° C. and with dwell times in the reactor of less than 1 minute often from about 0.1 to about 50 seconds.

According to the other possibility, a portion of the atmospheric residue that is obtained in stage d) is sent into a standard hydrocracking stage, a brief description of which will be found in, for example, ULLMANS ENCYCLOPEDIA OF INDUSTRIAL CHEMISTRY VOLUME A 18, 1991, pages 71, 75 and 76. In this case, at least one catalyst will be used that can be a catalyst that comprises an amorphous-type matrix, such as, for example, a silica-alumina, or a crystalline matrix, such as a zeolite. The selection of the catalyst and the operating conditions are dependent on the products that are sought based on the treated feedstock as described in, for example, the article by M. A. HENNICO and others that is published in the French Petroleum Institute Journal, Vol. 48, No. 2, March–April 1993, pages 127 to 139.

The following example illustrates the invention without limiting its scope.

EXAMPLE

A residue (RA) that results from the atmospheric distillation of a Safaniya crude is vacuum-distilled under conditions that make it possible to obtain a vacuum residue (RSV) whose main characteristics are presented in Table 1 below in column 1 and a vacuum distillate (DSV) whose main characteristics are presented in Table 1 below in column 3. When the atmospheric residue is counted by mass with a base of 100, the RSV represents 63.6 by mass and the DSV 36.4.

A hydroconversion pilot unit was used in which the catalyst was in an ebullated bed. This pilot unit makes it possible to account for the performance levels of the industrial hydroconversion process of residues (for example the H-Oil® process) and leads to performance levels that are identical to those of industrial units. The rate of replacement of the catalyst is 0.5 kg/m$^3$ of feedstock. The unit comprises two reactors that are arranged in series and that each have a volume of 3 liters.

In this pilot unit, the Safaniya vacuum residue that is mentioned above is treated.

The specific catalyst for the hydroconversion of residues in ebullated beds that is described in Example 2 of Patent U.S. Pat. No. 4,652,545 under reference HDS-1443B is used. The operating conditions are as follows.

VVH=0.5 relative to the catalyst

P=150 bar

T=425° C.

Recycling of hydrogen=500 $IH_2$/l of feedstock

The product is then successively fractionated in an atmospheric distillation column at the bottom of which an atmospheric residue (R1) is recovered. In the atmospheric distillation, distillate (D1) is recovered that is sent to fuel pools after separation into a gasoline fraction (E1) and a gas oil fraction (G1).

In the hydroconverted atmospheric residue line a filtration system was installed that makes it possible to eliminate the catalyst fines that can be generated in the ebullated-bed reactors (H-Oil®). This prevents the quick deactivation of the catalytic cracking catalyst (R2R) owing to the optional presence of molybdenum in the catalyst fines. This filtration system comprises two filters that are arranged in parallel, one of which is in service while the other is on standby or in regeneration, and operation switches from one to the other alternately when the pressure drops occur in the filter that is in service.

The yields and qualities of the products are presented in Tables 1, 2, and 3. All of the yields are calculated starting from a base of 100 (by mass) of RA or 63.6 (by mass) of RSV.

The characteristics of the atmospheric residue (R1) ex H-Oil® are presented in Table 1 in column 2. Those of gasoline (E1) ex H-Oil® in Table 2, column 1, and those of gas oil (G1) ex H-Oil® in Table 3, column 1.

Furthermore, vacuum distillate (DSV) is hydrotreated catalytically in a pilot unit that operates in a fixed catalyst bed. The catalyst that is used is catalyst HR348, which is produced by Procatalyse.

The operating conditions this time are as follows:

VVH=0.5

P=80 bar

T=380° C.

Recycling of hydrogen=600 $IH_2$ /l of feedstock.

The product is then fractionated successively in an atmospheric distillation column, at the bottom of which an atmospheric residue (R2) is recovered. In the atmospheric distillation, distillate (D2) is recovered which is sent to the fuel pools after separation into a gasoline fraction and a gas oil fraction.

The yields and qualities of the products are presented in Tables 1, 2, and 3. All of the yields are calculated starting from a base of 100 (by mass) of RA or 36.4 (by mass) of DSV.

The characteristics of hydrotreated atmospheric residue (R2) are presented in Table 1 in column 4. Those of gasoline (E2) ex hydrotreatment (ex HDT) in Table 2, column 2 and those of gas oil (G2) ex hydrotreatment (ex HDT) in Table 3, column 2.

Atmospheric residue R1 of the hydroconverted vacuum residue ex H-Oil® is then mixed with atmospheric residue R2 of hydrotreated vacuum distillate ex HDT. The characteristics of the mixture are presented in Table 1, column 5.

Tables 2 and 3 present the yields of gasoline and gas oils and the main characteristics of these products that are obtained in the entire process.

This mixture is treated in a pilot unit for catalytic cracking of residues. This unit makes it possible to reflect the performance levels of process R2R (IFP-TOTAL-STONE and WEBSTER).

The product of R2R is then fractionated successively in an atmospheric distillation column at the bottom of which a residue (R3 or slurry) is recovered. In the atmospheric distillation, distillate (D3) is recovered that is sent to the fuel pools after separation into a gasoline fraction (E3) and a gas oil fraction (G3).

The yields and qualities of the gasoline and the gas oil ex R2R are presented in Tables 2 and 3. All of the yields are calculated starting from a base of 100 of RA (DSV +RSV).

Finally, on the one hand, gasoline fractions (E1, E2, E3) that are respectively obtained from subsequent distillations are mixed with H-Oil, HDT, and R2R. The main characteristics of this gasoline mixture are presented in Table 2, column 4. On the other hand, gas oil fractions (G1, G2, G3) that are obtained from these same distillations are mixed. The main characteristics of this gas oil mixture are presented in Table 3, column 4. Thus, the high yields that are obtained are measured in terms of both gasoline and gas oil, and particularly in terms of gasoline.

TABLE 1

Yields and Qualities of the Feedstock and Products.

| Fraction | RSV Safaniya | R1 ex H-Oil | DSV Safaniya | R2 ex HDT | R1 + R2 |
|---|---|---|---|---|---|
| Yield/RA% by mass | 63.6 | 38 | 36.4 | 33 | 71 |
| Density 15/4 | 1.045 | 0.980 | 0.940 | 0.907 | 0.945 |
| Sulfur % by mass | 5.4 | 1.20 | 3.08 | 0.29 | 0.78 |
| Conradson carbon % by mass | 24 | 13.0 | 1.2 | 0.1 | 7.0 |
| Ni + V, ppm | 213 | 25 | 2 | <1 | 19 |
| Hydrogen % by mass | 10.0 | 11.2 | 11.9 | 12.6 | 11.8 |

TABLE 2

Results and Characteristics of the Gasoline that is Produced.

| | Gasoline (E1) ex H-Oil | Gasoline (E2) ex HDT | Gasoline (E3) ex R2R | Gasoline (E1 + E2 + E3) total |
|---|---|---|---|---|
| Yield/RA% by mass | 3.2 | 0.2 | 33.3 | 37 |
| Density 15/4 | 0.714 | 0.750 | 0.746 | 0.743 |
| Sulfur % by mass | 0.03 | 0.02 | 0.02 | 0.020 |
| Octane (RON + MON)/2 | 55 | 55 | 86 | 83 |

TABLE 3

Results and Characteristics of the Gas Oil that is Produced.

| | Gas Oil (E1) ex H-Oil | Gas Oil (E2) ex HDT | Gas Oil (E3) ex R2R | Gas Oil (E1 + E2 + E3) total |
|---|---|---|---|---|
| Yield/RA% by mass | 15.9 | 2.7 | 10.2 | 29 |
| Density 15/4 | 0.865 | 0.885 | 0.948 | 0.895 |
| Sulfur % by mass | 0.10 | 0.12 | 1.17 | 0.48 |
| Cetane | 44 | 41 | 23 | 36 |

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 98/03.654, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Process for converting a hydrocarbon fraction that contains basically the atmospheric residue from the direct distillation of a crude, characterized in that it comprises the following stages:

a) The hydrocarbon fraction is sent to a vacuum distillation zone from which a vacuum distillate and a vacuum residue are recovered, b) At least a portion of the vacuum distillate that is obtained in stage a) is treated in the presence of hydrogen in at least one hydrotreatment section that comprises at least one reactor that contains at least one fixed hydrotreatment catalyst bed under conditions that obtain a liquid feedstock with low contents of Conradson carbon, metals, and sulfur, c) At least a portion of the vacuum residue that is obtained in stage a) is treated in the presence of hydrogen in at least one hydroconversion section, whereby said section comprises at least one triphase reactor and contains at least one ebullated-bed hydroconversion catalyst under conditions that obtain a liquid feedstock with low contents of Conradson carbon, metals, and sulfur, d) At least a portion of the hydrotreated liquid effluent that is obtained from stage b) is sent to an atmospheric distillation zone from which an atmospheric distillate and a residue are recovered, e) At least a portion of the hydroconverted liquid effluent that is obtained from stage c) is sent to an atmospheric distillation zone from which an atmospheric distillate and an atmospheric residue are recovered; and f) At least a portion of the atmospheric residue that is obtained in stage d) is mixed with at least a portion of the atmospheric residue that is obtained in stage e), and this mixture is sent to a catalytic cracking residue section.

2. Process according to claim 1 for converting a hydrocarbon fraction that contains basically the atmospheric residue of the direct distillation of a crude, wherein it comprises the following stages:

a) The hydrocarbon fraction is sent to a vacuum distillation zone from which a vacuum distillate and a vacuum residue are recovered;

b) At least a portion of the vacuum distillate that is obtained in stage a) is treated in the presence of hydrogen in at least one hydrotreatment section that comprises at least one reactor that contains at least one fixed hydrotreatment catalyst bed under conditions that obtain a liquid feedstock with low contents of Conradson carbon, metals, and sulfur;

c) At least a portion of the vacuum residue that is obtained in stage a) is treated in the presence of hydrogen in at least one hydroconversion section, whereby said section comprises at least one triphase reactor and contains at least one ebullated-bed hydroconversion catalyst and operates with a rising flow of liquid and gas, whereby said reactor comprises at least one means of drawing off the catalyst to the outside of said reactor that is located close to the bottom of the reactor and at least one means of making up fresh catalyst in said reactor that is located close to the top of said reactor, under conditions that obtain a liquid feedstock with low contents of Conradson carbon, metals, and sulfur;

d) At least a portion of the hydrotreated liquid effluent that is obtained from stage b) is sent to an a tmospheric distillation zone from which an atmospheric distillate and a residue are recovered;

e) At least a portion of the hydroconverted liquid effluent that is obtained from stage c) is sent to an atmospheric distillation zone from which an atmospheric distillate and an atmospheric residue are recovered; and f) At least a portion of the atmospheric residue that is obtained in stage d) is mixed with at least a portion of the atmospheric residue that is obtained in stage e), and this mixture is sent into a catalytic cracking residue section in which it is treated under conditions that make it possible to obtain a gas fraction, a fuel fraction that comprises a gasoline fraction, a gas oil fraction, and a slurry fraction.

3. A process according to claim 1, wherein at least a portion of the vacuum distillate that is obtained in stage a) is sent in a mixture with the vacuum residue that is obtained in stage a) to hydroconversion stage c).

4. A process according to claim 1, wherein at least a portion of the atmospheric distillate that is obtained in stage e) is sent to stage b) in a mixture with the vacuum distillate that is obtained in stage a).

5. A process according to claim 1, wherein during stage b) at least two catalysts are used, whereby one of the catalysts mainly ensures demetalization and the other mainly ensures desulfurization under conditions that make it possible to obtain a liquid feedstock with low contents of metals, Conradson carbon, and sulfur.

6. A process according to claim 1, wherein during stage b) the treatment in the presence of hydrogen is carried out under an absolute pressure of 2 to 35 MPa at a temperature of about 300 to 500° C. with an hourly volumetric flow rate of about 0.1 to 10 $h^{-1}$.

7. A process according to claim 1, wherein hydroconversion stage c) is carried out under an absolute pressure of 2 to 35 MPa, at a temperature of about 300 to 550° C., and with an hourly volumetric flow rate of about 0.1 to 10 $h^{-1}$.

8. A Process according to claim 1, wherein in each of stages d) and e), the cutpoint is independently from about 300 to about 400° C., whereby the cutpoint during stage (a) is from about 300 to about 400° C.

9. A process according to claim 1, wherein in each of stages d) and e), the cutpoint is identical and is from about 300 to about 400° C.

10. A process according to claim 1, wherein at least a portion of the atmospheric residue that is obtained in stage e) is sent back to hydroconversion stage c).

11. A process according to claim 1, wherein at least a portion of the atmospheric residue that is obtained in stage e) is sent to the heavy fuel pool of the refinery.

12. A process according to claim 1, wherein at least a portion of the atmospheric residue that is obtained in stage d) can be sent to a standard fluidized-bed catalytic cracking stage, or to a hydrocracking stage.

13. A process according to claim 1, wherein catalytic cracking stage f) is carried out under conditions that so as to produce a gasoline fraction that is at least partly sent into the fuel pool, a gas oil fraction that is at least partly sent into the gas oil pool, and a slurry fraction that is at least partly sent into the heavy fuel pool.

14. A process according to one of claims 1 to 13, wherein at least a portion of the gas oil fraction that is obtained in catalytic cracking stage f) is recycled to stage b).

15. A process according to claim 13, wherein at least a portion of the gas oil fraction and/or of the gasoline fraction that is obtained in catalytic cracking stage f) is recycled to the input of stage f).

16. A process according to claim 13, wherein at least a portion of the slurry fraction that is obtained in catalytic cracking stage f) is recycled to the input of stage f).

17. A process according to claim 13, wherein at least a portion of the slurry fraction that is obtained in catalytic cracking stage f) is recycled to hydroconversion stage c).

18. A process according to claim 13, wherein at least a portion of the gas oil fraction that is obtained in catalytic cracking stage f) is recycled to hydroconversion stage c).

19. A process according to claim 1, wherein before the treatment section of stage (b), at least one or more reaction zone(s) are placed in a fixed bed, arranged in series or in parallel, and can operate alternately.

20. A process according to claim 1, wherein before the hydroconversion section of stage (c), at least one or more reaction zone(s) are placed in a fixed bed, arranged in series or in parallel, and can operate alternately.

* * * * *